US008596922B2

(12) United States Patent
McVay et al.

(10) Patent No.: US 8,596,922 B2
(45) Date of Patent: Dec. 3, 2013

(54) SYSTEMS AND METHODS FOR INSERTING AND SECURING FOUNDATION MEMBERS USING A COMBINATION OF JETS AND FLUIDIZED CONCRETE

(75) Inventors: Michael McVay, Gainesville, FL (US); Peter Lai, Tallahassee, FL (US); David G. Bloomquist, Gainesville, FL (US)

(73) Assignees: University of Florida Research Foundation, Inc.; Florida Department of Transportation

( * ) Notice: Subject to any disclaimer, the term of this patent is extended or adjusted under 35 U.S.C. 154(b) by 328 days.

(21) Appl. No.: 12/686,063

(22) Filed: Jan. 12, 2010

(65) Prior Publication Data

US 2010/0178115 A1 Jul. 15, 2010

Related U.S. Application Data

(60) Provisional application No. 61/143,931, filed on Jan. 12, 2009.

(51) Int. Cl.
*E02D 5/44* (2006.01)

(52) U.S. Cl.
USPC ..... 405/237; 405/232; 405/233; 405/244

(58) Field of Classification Search
USPC ..... 405/231, 232, 233, 235, 236, 237, 238, 405/244, 249, 252.1, 255
See application file for complete search history.

(56) References Cited

U.S. PATENT DOCUMENTS

| | | | | |
|---|---|---|---|---|
| 4,047,389 | A | 9/1977 | Yang | |
| 4,906,141 | A * | 3/1990 | Massarsch | 405/244 |
| 4,921,057 | A * | 5/1990 | Smet | 175/203 |
| 5,919,005 | A * | 7/1999 | Rupiper | 405/244 |
| 6,672,371 | B1 * | 1/2004 | Amerman et al. | 165/45 |
| 6,942,429 | B1 * | 9/2005 | Beck et al. | 405/236 |
| 7,004,684 | B2 * | 2/2006 | Fox | 405/237 |

FOREIGN PATENT DOCUMENTS

JP 2001 140255 5/2001

* cited by examiner

*Primary Examiner* — Benjamin Fiorello
(74) *Attorney, Agent, or Firm* — Alston & Bird LLP

(57) ABSTRACT

Systems and methods are provided for establishing and securing a foundation in a substrate. For example, in one embodiment, a pump conveys a first fluid (e.g., water) through a pile member to produce an elongate opening in a substrate, which allows the pile member to be advanced into the substrate. After the pile member has been advanced into the elongate opening in the substrate, a second fluid (e.g., fluidized concrete) is conveyed out of openings on the side (and the bottom) of the pile member to substantially secure the pile member in the elongate opening defined in the substrate.

21 Claims, 4 Drawing Sheets

SYSTEMS AND METHODS FOR INSERTING AND SECURING FOUNDATION MEMBERS USING A COMBINATION OF JETS AND FLUIDIZED CONCRETE

CROSS-REFERENCE TO RELATED APPLICATIONS

This application claims priority to U.S. Provisional Application No. 61/143,931, filed Jan. 12, 2009, which is hereby incorporated herein in its entirety by reference.

GOVERNMENT SPONSORED RESEARCH OR DEVELOPMENT

This invention was made with government support under Project BD545 RPWO #31 awarded by Florida Department of Transportation. The government has certain rights in the invention.

BACKGROUND

In most construction applications, two different types of foundations are used: shallow foundations (e.g., for a house); and deep foundations (e.g., for bridges, large buildings, and any structures on poor soils). When establishing deep foundations, the two most common systems conventionally used are: (1) cast-in-place concrete pile (commonly referred to as "auger cast pile" and/or "drilled shaft/pile"); and (2) driven, prefabricated (such as steel H or pipe, concrete or prestressed concrete). For example, cast-in-place pile systems are inserted into the ground by drilling a hole and filling the resulting hole with concrete, such as in a drilled shaft/pile. Prefabricated piles are driven into the ground using high impact forces from the driving system (e.g. hammer). Each type of deep foundation system has a number of advantages and disadvantages.

Conventional driven, prefabricated pile foundation systems generally improve the soil-pile resistance during driving compared to a cast-in-place pile. However, a driven pile can create substantial noise and ground vibration during installation—a process which must be carefully monitored so as to not impinge on the local environment. Furthermore, it is possible to damage prefabricated piles during driving, which may necessitate the costly and time-consuming removal and replacement of the pile. One way to avoid potential damage from and to a driven pile as well as reduce the noise generated from the pile driver is to use high pressure water to "jet" the prefabricated pile into the ground. While this process may be effective, the jetting process may also loosen the surrounding soil to such an extent that the pile's load-carrying capacity is substantially reduced.

Conventional cast-in-place systems (such as, for example, drilled shafts/pile and/or auger cast systems) limit potential damage to surrounding appurtenances (since very little energy is transmitted to adjacent structures) and are relatively quiet in operation. However, while cost effective and essentially impact-free during installation, conventional cast-in-place systems may result in a foundation that fails to retain its geometric properties (e.g., uniform diameter) because surrounding soil may fall away from the sidewalls of the hole or mix-in with the in-flowing concrete, which may substantially reduce the resulting foundation member's load capacity once the concrete has hardened. While these problems may or may not occur in a particular cast-in-place installation, it is very difficult to inspect or verify the condition of a cast-in-place foundation once it is installed. Therefore, confidence in a conventional cast-in-place foundation's design load-carrying capacity may never be assured.

BRIEF SUMMARY

Systems and methods are provided for establishing and securing a foundation in a substrate.

According to one aspect, a system for establishing and securing a foundation in a substrate is provided. In one embodiment, the system comprises a pile member defining at least a first outlet and a second outlet. The first outlet is adapted for outwardly conveying a first fluid from the pile member to thereby create an opening in the substrate for receiving at least a portion of the pile member, and the second outlet is adapted for outwardly conveying a second fluid from the pile member, the second fluid being adapted to substantially secure the pile member in the substrate.

According to another aspect, a pile member for being established and secured in a substrate is provided. In one embodiment, the pile member defines (a) a first outlet adapted for outwardly conveying a first fluid from the pile member to thereby create an opening in the substrate for receiving at least a portion of the pile member; and (b) a second outlet adapted for outwardly conveying a second fluid from the pile member, the second fluid being adapted to substantially secure the pile member in the substrate.

According to yet another aspect, a method for establishing and securing a foundation member in a substrate is provided. In one embodiment, the method comprises (a) providing a pile member (1) comprising one or more tip nozzles disposed near a distal end of the pile member and (2) defining one or more outlets in a side of the pile member; (b) conveying a first fluid outwardly from the one or more tip nozzles so as to define an elongate opening in a substrate for receiving at least a portion of the pile member; (c) advancing the pile member into the elongate opening defined in the substrate; and (d) conveying a first portion of a second fluid outwardly from the one or more outlets so as to substantially secure the pile member in the elongate opening defined in the substrate.

According to another aspect, a system for establishing and securing a foundation in a substrate is provided. In one embodiment, the system comprises a cast-in-place pile member defining at least an outlet, wherein the outlet is adapted for outwardly conveying a fluid from the cast-in-place pile member, the fluid being adapted to substantially secure the cast-in-place pile member in the substrate.

According to another aspect, a cast-in-place pile member for being established and secured in a substrate is provided. In one embodiment, the cast-in-place pile member defines a first outlet adapted for outwardly conveying a first portion of a fluid from the cast-in-place pile member to substantially secure the cast-in-place pile member in the substrate.

And according to still another aspect, a method for establishing and securing a foundation member in a substrate is provided. In one embodiment, the method comprises (1) providing a cast-in-place pile member defining (a) one or more outlets in a side of the cast-in-place pile member and (b) one or more outlets in a distal end of the cast-in-place pile member; and (2) conveying a first portion of a fluid outwardly from the one or more outlets in the side of the cast-in-place pile member so as to substantially secure the cast-in-place pile member in the substrate.

BRIEF DESCRIPTION OF THE SEVERAL VIEWS OF THE DRAWINGS

Reference will now be made to the accompanying drawings, which are not necessarily drawn to scale, and wherein.

DETAILED DESCRIPTION OF VARIOUS EMBODIMENTS

Figure 1:
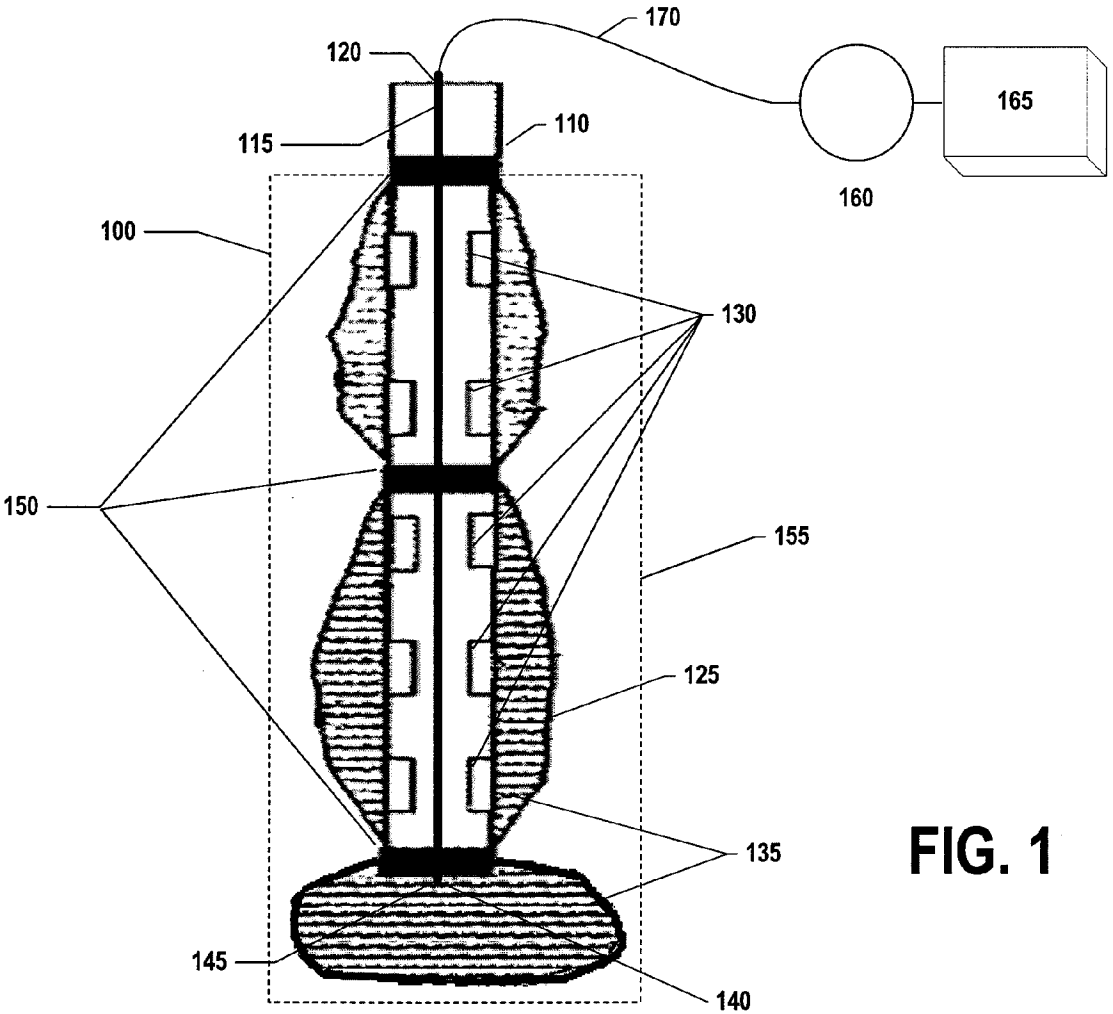
FIGS. 1 and 2 show exemplary cross-sections of a pile system according to one embodiment of the present invention.

Embodiments of the present inventions now will be described more fully hereinafter with reference to the accompanying drawings, in which some, but not all embodiments of the inventions are shown. Indeed, the inventions may be embodied in many different forms and should not be construed as limited to the embodiments set forth herein; rather, these embodiments are provided so that this disclosure will satisfy applicable legal requirements. Like numbers refer to like elements throughout.

I. Overview of Exemplary Pile System

Embodiments of the present invention include a pile system for establishing and securing a foundation member in a substrate. Generally, the pile system comprises a pile member to be secured in the substrate. In one embodiment, a pump conveys a first fluid (e.g., water) (a) through a jet conduit defined by the pile member and (b) out one or more jet tip nozzles included in an end cap attached to a distal end of the pile member. The pressurized outward conveyance of the first fluid from the jet tip nozzles produces an elongate opening in the substrate, which allows the pile member to be lowered into the substrate (in a direction substantially parallel to the longitudinal axis of the pile member).

After the pile member has been "jetted" to a desired depth within the substrate, the pump device "flushes" one or more u-shaped grout conduits defined by the pile member with water to, for example, remove any contaminants. It should be noted that cast-in-place pile members (e.g., drilled shafts/piles, auger cast piles, etc.) can be used with embodiments of the present invention as well. In one embodiment, each grout conduit defines a grout conduit inlet and a grout conduit outlet in the proximal end of the pile member. After flushing the grout conduit, the grout conduit outlet is sealed with a grout conduit cap. By sealing the grout conduit outlet, the pressure inside the grout conduit increases as grout is pumped into the grout conduit inlet which forces open one or more pressure-responsive valves, each of which is positioned to selectively limit the flow of a respective grout conduit opening defined by the grout conduit. This allows the grout to be conveyed out of the grout conduit openings and into a grout membrane surrounding the grout conduit openings of a given grout conduit. In various embodiments, the dimensions of the grout membrane determine the amount of grout that can be conveyed out of the grout conduit openings and into the grout membrane. Once the grout membrane is filled with grout, the interior of the grout conduit fills with grout (e.g., is grouted). This process is then repeated for each grout conduit in a top-down approach, e.g., starting with the grout conduit with the grout conduit openings closest to the proximal end of the pile member, and then proceeding to the grout conduit having the grout conduit openings that are the second closest to the proximal end of the pile member.

In one embodiment, after a particular grout conduit has been grouted, the jet conduit is grouted. For example, in one embodiment, the pump device first pumps grout into the jet conduit inlet. The grout travels through the jet conduit and out of the one or more jet tip nozzles disposed on the end cap at the distal end of the pile member. This allows for the elongate opening formed during jetting to be filled with grout to support the pile member.

The structure and function of an exemplary pile system are discussed in greater detail below.

II. Exemplary Components of Pile System

In one embodiment, the pile system 100 includes a pile member 110, a pump 160, and a fluid source 165, each of which is discussed in greater detail below.

A. Pile Member

Figure 2:
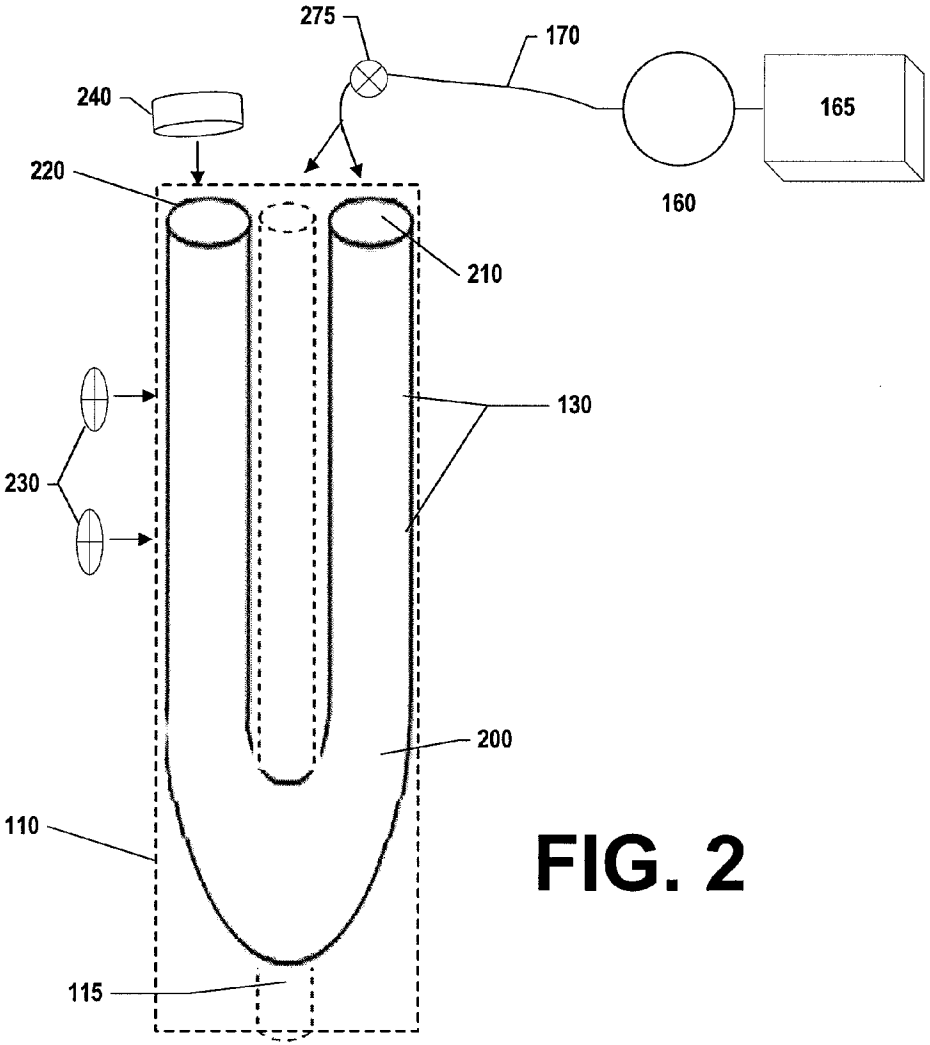
Figure 3B:
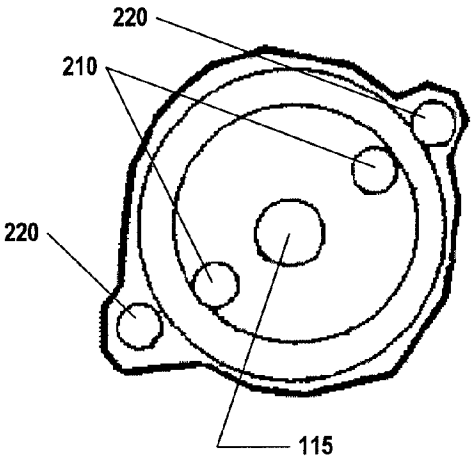
FIGS. 3A-3C show top views of a pile system according to embodiments of the present invention.
Figure 3C:
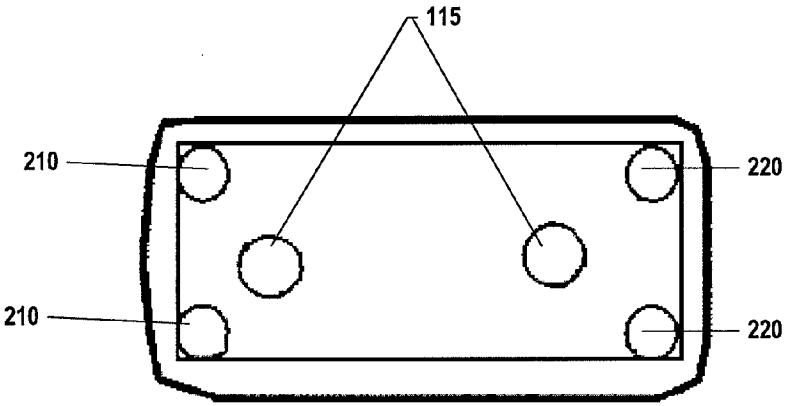
Figure 3A:
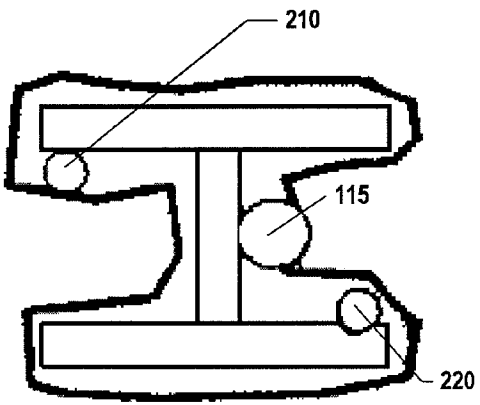

A pile member according to one embodiment of a pile system 100 is shown in FIGS. 1 and 2. In various embodiments, the pile member 110 may be a square, round, rectangular, triangular, octagonal, and/or the like structure capable of supporting an axial, lateral, and/or torsional load. The pile member 110 may, for example, be fabricated onsite or at a prefabrication facility from any of a variety of materials, such as concrete (e.g., reinforced concrete and pre-stressed concrete), steel, alloy, and the like. Similarly, the pile member 110 may be a cast-in-place structure (e.g., drilled shafts/piles, auger cast piles, etc.) that is cast in a substrate. As may be understood from FIGS. 1 and 2, in this embodiment, the pile member 110 comprises: (1) a jet conduit 115; (2) an end cap 400; (3) a grout conduit 200; (4) a pressure gauge; and (5) a grout membrane 125.

i. Jet Conduit

In various embodiments, the pile member 110 defines one or more jet conduits 115 extending length-wise through the pile member 110 (e.g., substantially parallel to the pile member's 110 longitudinal axis). In one embodiment, the jet conduit 115 comprises a polyvinyl chloride ("PVC") pipe with a diameter suitable for conveying fluids under pressure (e.g., about 1-3 inches). As will be recognized, though, the jet conduit 115 may also be made of any appropriate material, including, copper pipe, metallic and/or metallic alloy pipe, and/or other types of metallic and/or copper piping suitable for conveying fluids under pressure (e.g., pressurized fluidized concrete ("grout 135") and/or pressurized water and/or air). Alternatively, the jet conduit 115 may be made of the same material as the pile member 110, and the diameter of the jet conduit 115 may be of any appropriate size for conveying fluids under pressure (which may vary based upon the material used to make the pile member). Irrespective of the material composition and diameter of the jet conduit 115, the jet conduit 115 defines a jet conduit inlet 120 near the proximal (and/or "upper") end of the pile member 115 and a jet conduit outlet 140 near the distal (and/or "lower") end of the pile member 115.

ii. End Cap

As shown in FIG. 4, in one embodiment, an end cap 400 is attached to the distal end of the pile member 115 at the jet conduit outlet 140. The end cap 400 (examples of which are shown in FIGS. 4A-4D) may be made out of steel, alloy metal, or hard fiber glass/graphite reinforced plastics. And the end cap 400 may be attached to the pile member 115 in any of a variety of ways, including via appropriate fasteners, such as screws, nails, glue, and/or cement or cast into the pile proper.

Figure 4C:
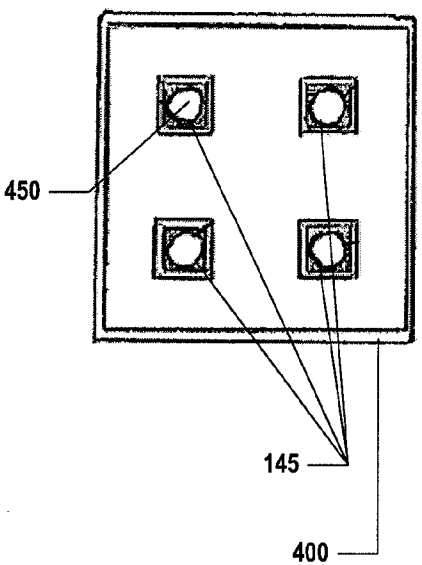
FIG. 4C shows a set of exemplary variable-geometry nozzles according to one embodiment of the present invention.
Figure 4B:
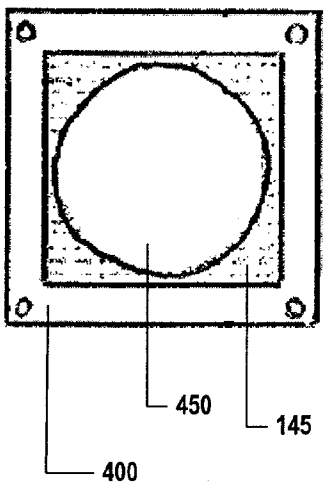
FIGS. 4A and 4B show variable-geometry nozzles that may be used in a pile system according to embodiments of the present invention.
Figure 4D:
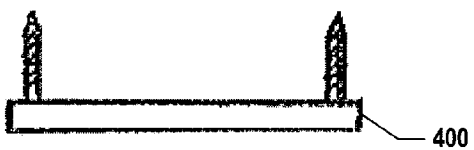
FIG. 4D shows a side view of an exemplary variable-geometry nozzle assembly that may be disposed in an end cap according to one embodiment of the present invention.
Figure 4A:
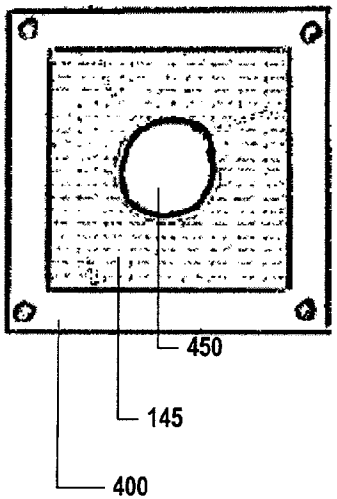

In various embodiments, one or more jet tip nozzles 145 are included in the end cap 400 (see FIG. 4D, for example). In various embodiments, the jet tip nozzles 145 are made of an expandable nozzle material, such as a latex material or rubber. Each of the jet tip nozzles 145 may be formed using any of a variety of cross-sectional shapes that include, but are not limited to, rectangular and oval shapes. The configuration (and number) of the jet tip nozzles 134 can be adjusted and/or rearranged to optimize the "jetting" action achieved by the pressurized water, air, and/or the like conveyed out the jet tip nozzles 145. As shown in FIGS. 4A-4C, there may be one or more jet tip nozzles 145 (with each jet tip nozzle 145 defining a jet tip nozzle opening 450) included in the end cap 400. For example, in the embodiments shown in FIGS. 4A and 4B, the end cap 400 includes a single jet tip nozzle 145. In the embodiment shown in FIG. 4C, the end cap 400 includes four jet tip nozzles 145 near the respective corners of the end cap 400. In these embodiments, the end cap 400 is attached to the pile member 110 and the one or more jet tip nozzles 145 are in fluid communication with the jet conduit 115.

In another embodiment, the one or more jet tip nozzles 145 are adapted such that the jet tip nozzles 145 move between a first configuration and a second configuration in response to a change in a particular operating condition (e.g., in response to an increased fluid pressure, fluid density, or fluid temperature within the jet tip nozzles 145). In other words, the nozzles may have a pressure-responsive size—i.e., the nozzle size being larger under greater pressure conditions and smaller under lesser pressure conditions. For example, in one embodiment, the one or more jet tip nozzles 145 are made of an expandable nozzle material, such as a latex or neoprene material. The stiffness and thickness parameters of the latex/neoprene material may be adjusted such that the size of the jet tip nozzle opening 450 can remain relatively small under low pressure conditions, but expand to a larger size under high pressure conditions (e.g., grouting occurs at a higher pressure than jetting). In a particular embodiment, the jet tip nozzle's opening 450 is smaller in the first configuration (e.g., FIG. 4A) than in the second configuration (e.g., FIG. 4B). Correspondingly, in various embodiments, the jet tip nozzle's opening 450 may be at least about 50%, 100%, 200%, 300%, or 400% smaller in the first configuration than it is in its second configuration. This allows the jet tip nozzle 145 to perform differently under different pressure conditions iii. Grout Conduit In various embodiments, the pile member 110 also defines one or more grout conduits 200. In one embodiment, each grout conduit 200 extends lengthwise down the pile member 110 from a grout conduit inlet 210 defined at the proximal end of the pile member 110, forms a u-shape within the body of the pile member 110, and extends lengthwise up the pile member 200 to a grout conduit outlet 220 defined at the proximal end of the pile member 110 (shown in FIGS. 2 and 3A-3C). And because the jet conduit 115 also extends lengthwise down the pile member 110, in one embodiment, the grout conduit 200 is offset from the jet conduit 115 within the body of the pile member 110. However, the jet conduit 115 may be offset from the grout conduit 200, such that it is not substantially centered in relation to the edges of the pile member 110.

With respect to the composition of the grout conduits 200, in one embodiment, the grout conduits 200 comprise a PVC pipe with a diameter of 1-3 inches. As will be recognized, though, the grout conduits 200 may be made of copper pipe, metallic and/or metallic alloy pipe, and/or other types of metallic and/or copper piping suitable for conveying fluids under pressure (e.g., pressurized fluidized concrete ("grout") and/or pressurized water and/or air). In another embodiment, the grout conduits 200 may be made of the same material as the pile member 110 and be of any appropriate size.

In addition to comprising a grout conduit inlet 210 and a grout conduit outlet 220, each grout conduit 200 defines a passage extending to the exterior of the pile member 110 via one or more grout conduit openings 130. The grout conduit openings 130 may be of any suitable shape and size to allow for grout 135 to be conveyed from the grout conduit openings 130 to the exterior of the pile member 110. For example, in one embodiment, the grout conduit openings 130 have a circular shape and a diameter of 1-3 inches.

To prevent contaminants (e.g., dirt and silt) from entering the grout conduit 200 via the grout conduit openings 130, each grout conduit opening 130 can have attached thereto a pressure-responsive, expandable (e.g., gum rubber, neoprene, latex) valve 230. The valves 230 are attached to the grout conduit openings 130 using clamps, screws, bolts, glues, cement, friction fitting, and/or the like. In one embodiment, the valves remain closed under low pressure conditions (e.g., during jetting and flushing), but open under high pressure conditions (e.g., during grouting). This pressure-responsiveness and expandability allows for grout 135 to pass out of the grout conduit openings 130 under high pressure conditions, while limiting contaminants from entering the grout conduit openings 130 from the exterior of the pile member 110 under low pressure conditions.

iv. Pressure/Stress Gauges

In one embodiment, the pile system 100 comprises one or more pressure/stress gauges 275 (e.g., a neoprene bladder, glycerin/water fluid, and a pressure/stress gage). In various embodiments, each pressure/stress gauge 275 is adapted to accurately measure the air and/or water jetting and grouting delivery pressures during installation by slightly expanding a cylindrical membrane whose exterior is encapsulated in a rigid pipe and whose annulus is filled with incompressible fluid, such as silicon/glycerin oil. In particular embodiments, there are two pressure/stress gauges 275 used in the pile system 100—an upstream pressure/stress gauge 275 (near the grout conduit inlet 210) and a downstream pressure/stress gauge 275 (near the grout conduit outlet 220). As the water or grout is pumped into the grout conduit inlet 210 of the pile member 110, the upstream pressure/stress gauge 275 measures the delivered pressure of the fluid entering the pile member 110 by forcing the cylindrical membrane through which the water/grout is flowing to slightly deform and/or expand its diameter. The deformation is transmitted through the incompressible fluid (silicon/glycerin oil) and registered on the attached pressure gage. The pressure/stress gauge readout can be mechanical or digital. Unlike current gauges in use, various embodiments of the described pressure/stress gauge 275 may not be substantially affected by grout that partially sets during grouting and occludes the transmission of the applied pressure to the readout instrument.

Thus, as described, the one or more pressure/stress gauges 275 are placed in the grout conduit 200 and/or the jet conduit 115 to measure the pressure of the water, air, or grout within the conduits. In this way, the pressure/stress gauges 275 can determine, for example, if the grout 135 passing through the grout conduit 200 is sufficient to open the valves 230. Similarly, the one or more pressure/stress gauges 275 can help determine if there is a problem when the grout 135 is being conveyed out the grout openings 130. For example, if the grout pressure of a grout conduit inlet 210 were to suddenly drop, then a problem with a grout membrane 125 might be detected, such as a rip in the grout membrane 125. In contrast, a pressure spike would likely indicate that the grout conduit 130 is plugged. Additionally, if one pressure/stress gauge 275 is placed near the grout conduit inlet 210 and another outside of the pile member 110 within the ground, then the grout pressure within the ground may be established.

v. Grout Membrane

As shown in FIG. 1, in one embodiment, the pile member 110 is at least partially encapsulated/wrapped (e.g., enclosed or surrounded) by one or more semi-permeable grout membranes 125. The grout membranes 125 can be made of any of a variety of materials, such as woven cloth, polymers, glass fibers, etc. a desired tensile strength with or without reinforcement. The grout membrane 125 may be in various shapes and sizes that generally form a flexible "bag" with specified tensile strength encapsulating/wrapping at least a portion of the pile member 110. The semi-permeability of the grout membrane 125 allows water (and other liquids or gases) to pass through the grout membrane 125, while substantially preventing contaminants (e.g., silt size particles) from entering the grout membrane 125.

To encapsulate/wrap the grout conduit openings 130 of a grout conduit 200, each grout membrane 125 may be attached to the exterior or at the wall of the pile member 110. The grout membrane 125 may be attached to the pile/shaft in any of a variety of ways including by using collars, clamps, screws, bolts, glues, cement, and/or the like. In the embodiment shown in FIG. 1, the pile/shaft member 110 is preformed with bolts or screws protruding from its side walls above and below the set of grout conduit openings 130 for each grout conduit 200. In this embodiment, a grout membrane 125 is slid down (or otherwise configured to encapsulate/wrap at least a portion of) the axis of the pile member 110 and attached to the protruding bolts or screws using a collar 150. For example, in one embodiment, a first ring fastener (e.g., collar) secures an upper edge of the grout membrane 125 to a first circumferential surface of the pile member 110. And a second ring fastener (e.g., collar) secures a lower edge of the grout membrane 125 to a second circumferential surface of the pile member 110. This facilitates encapsulating/wrapping the grout conduit openings 130 of a grout conduit 200 with a grout membrane 125.

In one embodiment, the grout conduit openings 130 of each grout conduit 200 are encapsulated/wrapped by a single grout membrane 125. Thus, for example, in an embodiment with two grout conduits 200, the grout conduit openings 130 of the first grout conduit 200 are encapsulated/wrapped by a first grout membrane 125 and the grout conduit openings 130 of the second grout conduit 200 are encapsulated/wrapped by a second grout membrane 125. Because the embodiment in FIG. 1 includes two grout conduits 200, two grout membranes 125 are attached to the pile member 110—corresponding to the two separate grout conduits 200 and their respective grout conduit openings 130. In some embodiments, a grout membrane may be present only at some portions of the pile member while being absent from other portions of the pile member.

In an embodiment not shown, the distal end of the pile member 110 can also be partially encapsulated/wrapped (e.g., enclosed or surrounded) by a semi-permeable grout membrane 125. In such an embodiment, one or more jet conduits 115 extend substantially length-wise through the pile member 110 (e.g., substantially parallel to the pile member's 110 longitudinal axis) and outward from the sides of the distal end of the pile member 110. Additionally, one or more grout conduits extend substantially length-wise through the pile member 110 (e.g., substantially parallel to the pile member's 110 longitudinal axis) and outward from the distal end of the pile member 110. This embodiment allows (a) for the jetting to be performed proximate the distal end of the pile member 110 and (b) for a grout membrane 125 to substantially encapsulate/wrap the distal end of the pile member 110 to limit the outward expansion of grout from the distal end of the pile member 110.

In various embodiments, the encapsulating and semi-permeable nature of the grout membranes 125 (1) limits the outward expansion of the grout 135 from the pile member 110; (2) allows for liquids and/or gases to enter and exit the grout membrane 125; (3) ensures there is a relatively clean surface for optimal bonding between the grout 135 and the pile member 110; and/or (4) provides the ability to determine the load transfer capability of the pile member 110 and the grout 135 based on the capacity of the grout membrane 125 (for example, the membrane may be configured to expand enough to create a passive soil stress state around the pile member 110, e.g., expanding ¼ of the diameter of the pile member 110). In one embodiment, a grout membrane 125 may comprise one or more reinforced sections to substantially control the shape of the grout membrane 125.

B. Pump and Fluid Source

In one embodiment, the pile system 100 includes a pump 160 and a fluid source 165. For example, in one embodiment, the one or more jet conduits 115 are in fluid communication with a fluid/gas source 165 attached to a pump device 160 that supplies the fluid/gas from the fluid/gas source 165. The fluid/gas source 165 may comprise one or more reservoirs, tanks, and/or other containers located upstream from the pump device 160. The pump device 160 comprises a tube/pipe 170 assembly downstream from the pump device 160 to deliver the fluid/gas (e.g., water or air) to the one or more jet conduits 115. This facilitates establishing the pile member 110 in the substrate 155.

The one or more grout conduits 200 are in fluid communication with a fluid/gas source 165 attached to a pump device 160 that supplies the fluid/gas from the fluid/gas source 165. The fluid/gas source 165 may comprise one or more reservoirs, tanks, and/or other containers of fluidized concrete (also referred to herein as "grout") located upstream from the pump device 160. The pump device 160 comprises a tube/pipe 170 assembly downstream from the pump device 160 to deliver the fluid/gas to the one or more jet conduits 115. The pump device 160 may be the same pump device 160 used to the deliver the fluid or gas (e.g., fluidized concrete or "grout") to establish the pile member 110 in the substrate 115, or a separate pump device 160. This facilitates securing the pile member 110 in the substrate 115.

The grout 135 (e.g., fluidized concrete) used to secure the pile member 110 in the substrate 155 comprises various materials. For example, the materials may include cement, micro fly ash, chemicals, and water in different proportions depending on the portion of the pile member 110 being grouted. Other grout 135 alternatives include different proportions of cement, fly ash, clay, sand, chemicals, water, and polymers. Any appropriate grout system could be used with the inventive system.

III. Exemplary Operation of Pile System

In operation, according to one embodiment, the pile/shaft system 100 is used to establish and secure a pile member 110 in a substrate 155. To do so, a first fluid (such as pressurized water and/or air) is conveyed through the jet conduit 115 via the pump device 160. That is, the pump device 160 conveys the first fluid from the fluid/gas source 165 into the jet conduit inlet 120, through the jet conduit 115, through the jet conduit outlet 140, and out the jet tip nozzles 145 included in the end cap 400 of the pile member 110. The pressurized outward conveyance of the first fluid from the jet tip nozzles 145 produces an elongate opening in the substrate 155 (such as the ground of a construction site), which allows the pile member 110 to be lowered into the substrate 155 (in a direction substantially parallel to the longitudinal axis of the pile member 110). That is, by conveying water, air, and/or the like through the jet tip nozzles 145, the substrate 155 (e.g., sand, silt, clay, etc.) near the jet tip nozzles 145 begins to erode and thereby allows the pile member to be established (e.g., lowered) into the substrate 155. This technique is referred to as "jetting" the pile member 110 into the substrate 155. In addition to using jet tip nozzles 145 to erode the substrate 155, mechanical devices (such as a hydro-powered cutter) may also be used to grind and/or erode the substrate 155.

In one embodiment, after the pile member 110 has been "jetted" to a desired depth within the substrate 155, the pump device 160 "flushes" the grout conduit 200 with water, for example, to remove any contaminants from the grout conduit 200. In this embodiment, the u-shape of the grout conduit 200 allows for it to be flushed with water that enters through the grout conduit inlet 210, travels through the grout conduit 200, and exits through the grout conduit outlet 220.

In one embodiment, once the grout conduits 200 are flushed, the pile member 110 is prepared to be reinforced and/or secured in the substrate 155. In one embodiment, multiple u-shaped grout conduits 200 are used to secure the pile member 110 in the substrate 155 by employing a "staged grouting" process. Staged grouting generally refers to grouting the different sections of the pile member corresponding to the respective grout conduits 200 (and/or the jet conduit 115) in a sequence in order to insure limit stress states develop along the sides and bottom of the pile/shaft interface. Grouting performed using a staged, top-down approach, in one embodiment, provides for accurate measurements to determine the grout pressures in the substrate 155 (for example, to determine the pile member's 110 load capacity). It should be noted that any combination and sequence of the following can be grouted: the grout conduits 200 and the jet conduit 115. In one embodiment, the grout in combination with the membranes improves the soil pile resistance, through the attainment of limit stress states resulting in the improvement of the side friction and distal end resistance of the pile member 110.

In staged and un-staged grouting, a grout conduit cap 240 is secured to the grout conduit outlet 220. By sealing the grout conduit outlet 220, the pressure inside the grout conduit 200 increases as the grout 135 (or fluids/gases) is pumped into the grout conduit inlet 210, which forces open the valves 230 attached to the grout conduit openings 130 and allows the grout 135 to be conveyed out the grout conduit openings 130 into the grout membrane 125. That is, in response to the appropriate amount of pressure, the valves 320 expand and open such that they convey the pumped grout 135 (or fluids/gases) into the grout membrane 125. In one embodiment, the valves 230 are designed to open when the pressure exceeds a specific threshold (e.g., during the grouting of the pile member 110), such as 30 psi, and close or remain closed when the pressure is below the threshold (e.g., during flushing of the grout conduit 200).

In an illustrative process of staged grouting using a pile member 110 with the two grout conduits 200, a second fluid (e.g., grout) is pumped into the first grout conduit 210. In this step, as the pressure in the interior of the first grout conduit 200 increases such that the valves 230 are opened, the grout 135 is conveyed out through the grout conduit openings 130 of the first grout conduit 200. A first grout membrane 125 (of a particular shape and dimension) then receives the grout conveyed out of the grout conduit openings 130. The dimensions of the first grout membrane 125 determine the amount of grout 135 that can be conveyed into the first grout conduit 200 and out the grout conduit openings 130. After the first grout membrane 125 has been filled with grout 135, the interior of the first grout conduit 200 fills with grout 135 until it reaches the grout conduit inlet 210. This process is then repeated for the second grout conduit 200. For example, the pump device 160 conveys the second fluid (e.g., grout) into a second grout conduit 210 such that the grout 135 is conveyed into and fills a second grout membrane 125 and then the grout conduit until specified volumes and or limit stress states are reached 200.

In one embodiment, during grouting, the grout volume and pressure are monitored, recorded, and controlled with the assistance of one or more pressure/stress gauges. If the pressure/stress gauges detect a drop in pressure, e.g., caused by a tear in the grout membrane 125, the u-shaped grout conduit 200 can be flushed such that grouting can be completed at a later time. For example, the grout conduit cap 240 can be removed, and the pump device 160 can pump water (or other fluids) into grout conduit 200 to flush the grout out of the grout conduit outlet 220. In addition to or alternatively, the grout conduit 200 can be flushed with the grout conduit cap 240 secured to the grout conduit outlet 220. In this embodiment, the water (or other fluid) is forced out the grout conduit openings 130 and into the grout membrane 125. In various embodiments, the semi-permeable nature of the grout membrane 125 allows the water used to flush the grout conduit 200 to exit the grout membrane 125 over time. This process flushes out the grout conduit 200 and the grout conduit openings 130 such that grouting can be completed at a later time.

In one embodiment, after the first and second grout conduits 200 have been grouted, the jet conduit 115 is grouted. In this embodiment, the pump device 160 pumps the second fluid (e.g., grout 135) into the jet conduit inlet 120. The grout 135 travels through the jet conduit 115 and out the one or more jet tip nozzles 145 included in the end cap at the distal end of the pile member 110. This allows for the elongate opening formed during jetting to be filled with grout to support the pile member 110. It should be noted that in grouting the jet conduit 115, the pile member 110 may be slightly raised from its position prior to the grouting. In an embodiment with multiple jet conduits 115, this process is repeated for the other jet conduits 115.

In an embodiment with the expandable jet tip nozzles 145, the conveyance of the grout 135 through the jet tip nozzles 145 may cause them to expand. In this embodiment, the latex/neoprene material is adapted to define a relatively small jet tip nozzle opening 450 during the jetting process and a relatively large jet tip nozzle opening 450 during the grouting process (e.g., grout is delivered under higher pressure than fluid of the jetting process). Accordingly, the jet tip nozzle's opening 450 is adapted to expand substantially linearly in relation to a particular operating condition such as fluid pressure, fluid density, or fluid temperature. This functionality, allows the jet tip nozzles 145 to serve dual functions in the pile system 100. That is, in this embodiment, the jet tip nozzles 145 are configured to convey both: (1) pressurized water and air (e.g., the first fluid during the jetting process for defining the elongate opening); and (2) grout 135 (e.g., the second fluid for securing the distal end of the pile member 110 in the elongate opening). And similar to the grout conduit 200, the grout volume and pressure in the jet conduit 115 can be monitored, recorded, and controlled with the assistance of one or more pressure/stress gauges.

In a cast-in-place embodiment (not shown), an opening is created (e.g., dug) in a substrate and a grout membrane is lowered into the opening. Moreover, grout conduits 200 are configured to extend longitudinally from the opening to the distal end of the grout membrane 125. At this point, a pile member 110 is cast-in-place. After the cast-in-place pile member 110 hardens, the pile member is grouted as described above.

IV. Conclusion

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A system for establishing and securing a foundation in a substrate, the system comprising:

a pile member defining at least a first outlet and a second outlet with at least a portion of the pile member being at least partially encapsulated by a membrane, wherein:

the first outlet is adapted for outwardly conveying a first fluid from the pile member to thereby create an opening in the substrate for receiving at least a portion of the pile member, and the second outlet is adapted for outwardly conveying a second fluid from the pile member into the membrane, wherein (a) the membrane substantially limits the amount of the second fluid that can be outwardly conveyed from the second outlet, (b) the second fluid is adapted to substantially secure the pile member in the substrate, and (c) the second fluid comprises fluidized concrete.

2. The system of claim 1, wherein the first outlet is further adapted for outwardly conveying the second fluid from the pile member to substantially secure the pile member in the substrate.

3. The system of claim 1, wherein the first outlet comprises a tip nozzle disposed near a distal end of the pile member to create the opening in the substrate.

4. The system of claim 1, wherein the second outlet is in fluid communication with a substantially u-shaped conduit defined by the pile member.

5. The system of claim 4 further comprising a pump to convey the first fluid outwardly from the first outlet of the pile member to thereby create the opening in the substrate.

6. The system of claim 5, wherein the pile member further defines a third outlet, and wherein the third outlet (a) is in fluid communication with the substantially u-shaped conduit defined by the pile member and (b) is adapted for outwardly conveying the second fluid from the pile member to substantially secure the pile member in the substrate.

7. The system of claim 1 further comprising an expandable valve disposed on the second outlet, the expandable valve adapted for opening under a predetermined pressure to convey the second fluid outwardly from the pile member.

8. A pile member for being established and secured in a substrate, the pile member defining:

a first outlet adapted for outwardly conveying a first fluid from the pile member to thereby create an opening in the substrate for receiving at least a portion of the pile member; and a second outlet adapted for outwardly conveying a second fluid from the pile member with at least a portion of the pile member being at least partially encapsulated by a membrane, wherein (a) the membrane substantially limits the amount of the second fluid that can be outwardly conveyed from the second outlet, (b) the second fluid is adapted to substantially secure the pile member in the substrate, and (c) the second fluid comprises fluidized concrete.

9. The pile member of claim 8, wherein the first outlet is further adapted for outwardly conveying the second fluid from the pile member to substantially secure the pile member in the substrate.

10. The pile member of claim 8, wherein the first outlet comprises a tip nozzle disposed near a distal end of the pile member to create the opening in the substrate.

11. The pile member of claim 8, wherein the second outlet is in fluid communication with a substantially u-shaped conduit defined by the pile member.

12. The pile member of claim 11, wherein the pile member further defines a third outlet, and wherein the third outlet (a) is in fluid communication with the substantially u-shaped conduit defined by the pile member and (b) is adapted for outwardly conveying the second fluid from the pile member to substantially secure the pile member in the substrate.

13. The pile member of claim 8 further comprising an expandable valve disposed on the second outlet, the expandable valve adapted for opening under a predetermined pressure to convey the second fluid outwardly from the pile member.

14. A method for establishing and securing a foundation member in a substrate, the method comprising:

providing a pile member (a) comprising one or more tip nozzles disposed near a distal end of the pile member, (b) defining one or more outlets in a side of the pile member, and (c) comprising a membrane that at least partially encapsulates a portion of the pile member, wherein the membrane substantially limits the amount of fluid that can be outwardly conveyed from the one or more outlets in the side of the pile member;

conveying a first fluid outwardly from the one or more tip nozzles so as to define an elongate opening in a substrate for receiving at least a portion of the pile member;

advancing the pile member into the elongate opening defined in the substrate; and conveying a first portion of a second fluid outwardly from the one or more outlets so as to substantially secure the pile member in the elongate opening defined in the substrate, wherein the second fluid comprises fluidized concrete.

15. The method of claim 14, further comprising:

allowing the first portion of the second fluid to set up between the side of the pile member and a wall of the elongate opening; and conveying a second portion of the second fluid outwardly from the one or more tip nozzles so as to substantially secure the distal end of the pile member in the elongate opening.

16. The method of claim 15, further comprising detecting a movement of a proximal end of the pile member while conveying the second portion of the second fluid outwardly from the tip nozzle so as to assess an axial load-bearing capacity of the secured pile member.

17. A cast-in-place pile member for being established and secured in a substrate, wherein:

the cast-in-place pile member (a) defines a first outlet and a second outlet in a side of the cast-in-place pile member, the first outlet and the second outlet adapted for outwardly conveying a fluid from the cast-in-place pile member, and (b) comprises a membrane that at least partially encapsulates an exterior portion of the side of the cast-in-place pile member and the first outlet and the second outlet defined in the side of the cast-in-place pile member, wherein (c) the membrane substantially limits the amount of fluid that can be outwardly conveyed from the first outlet and the second outlet, (d) the fluid is adapted to substantially secure the cast-in-place pile member in the substrate, (e) the fluid comprises fluidized concrete, and (f) the first outlet and the second outlet are in fluid communication with a substantially u-shaped conduit defined by the cast-in-place pile member.

18. A method for establishing and securing a foundation member in a substrate, the method comprising:

providing a cast-in-place pile member (a) defining one or more outlets in a side of the cast-in-place pile member, (b) defining one or more outlets in a distal end of the cast-in-place pile member, and (c) comprising a membrane that at least partially encapsulates a portion of the pile member, wherein the membrane substantially limits the amount of fluid that can be outwardly conveyed from the one or more outlets in the side of the cast-in-place pile member;

conveying a first portion of a fluid outwardly from the one or more outlets in the side of the cast-in-place pile member so as to substantially secure the cast-in-place pile member in the substrate, wherein the first portion of the fluid comprises fluidized concrete.

19. The method of claim 18, further comprising:

allowing the first portion of the fluid to set up between the side of the cast-in-place pile member and a wall of the substrate; and conveying a second portion of the fluid outwardly from the one or more outlets in the distal end of the cast-in-place pile member to substantially secure the distal end of the cast-in-place pile member in the substrate.

20. The method of claim 19, further comprising detecting a movement of a proximal end of the cast-in-place pile member while conveying the second portion of the fluid outwardly from the one or more outlets in the distal end of the cast-in-place pile member to assess an axial load-bearing capacity of the secured cast-in-place pile member.

21. A cast-in-place pile member for being established and secured in a substrate, wherein the cast-in-place pile member:

defines one or more outlets in a side of the cast-in-place pile member adapted for outwardly conveying a fluid from the cast-in-place pile member, wherein the one or more outlets in the side of the cast-in-place pile member are in fluid communication with a substantially u-shaped conduit defined by the cast-in-place pile member, defines one or more outlets in a distal end of the cast-in-place pile member, and comprises a membrane that at least partially encapsulates an exterior portion of the side of the cast-in-place pile member and the one or more outlets defined in the side of the of the cast-in-place pile member, wherein (a) the membrane substantially limits the amount of the fluid that can be outwardly conveyed from the one or more outlets in the side of the cast-in-place pile member and (b) the fluid comprises fluidized concrete adapted to substantially secure the cast-in-place pile member in the substrate.

* * * * *